US006849817B2

(12) United States Patent
Takata et al.

(10) Patent No.: US 6,849,817 B2
(45) Date of Patent: Feb. 1, 2005

(54) SWITCHING DEVICE INCLUDING STOPPER SURFACE-MOUNTED ON PRINTED CIRCUIT BOARD

(75) Inventors: Tomosuke Takata, Miyagi-ken (JP); Hideki Ueno, Miyagi-ken (JP); Koichi Yamamoto, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/844,141

(22) Filed: May 12, 2004

(65) Prior Publication Data

US 2004/0226810 A1 Nov. 18, 2004

(30) Foreign Application Priority Data

May 16, 2003 (JP) ..... 2003-138725

(51) Int. Cl.[7] ..... H01H 9/00

(52) U.S. Cl. ..... 200/339; 200/1 B; 200/296; 200/292

(58) Field of Search ..... 200/1 R, 4, 1 B, 200/5 R, 6 R, 6 A, 17 R, 18, 339, 296, 553, 292

(56) References Cited

U.S. PATENT DOCUMENTS 5,382,768 A * 1/1995 Kurek et al. ..... 200/556
5,692,044 A * 11/1997 Hughes et al. ..... 379/422
5,896,768 A * 4/1999 Cranick et al. ..... 70/264
6,642,459 B2 * 11/2003 Chou et al. ..... 200/11 TW
6,680,444 B1 * 1/2004 Lee ..... 200/4
6,750,409 B1 * 6/2004 Samodell ..... 200/50.32
6,771,992 B1 * 8/2004 Tomura et al. ..... 455/575.1

FOREIGN PATENT DOCUMENTS

| | | |
|---|---|---|
| EP | 0 918 344 | 5/1999 |
| EP | 1 182 676 | 2/2002 |
| JP | 9-274830 | 10/1997 |
| JP | 9-306296 | 11/1997 |
| JP | 2000-208311 A | 7/2000 |
| JP | 2003-331692 | 11/2003 |

OTHER PUBLICATIONS

Search Report dtaed Oct. 13, 2004 for European Patent Application No. 04 01 1408.

* cited by examiner

*Primary Examiner*—Michael A. Friedhofer
(74) *Attorney, Agent, or Firm*—Brinks Hofer Gilson & Lione

(57) ABSTRACT

A switching device includes a switch body, a side knob, a returning mechanism, and a stopper. The switch body has a controlling unit which can be tilted and depressed. The switch body is surface-mounted on the printed circuit board. The side knob is attached to the controlling unit of the switch body. The switch body includes the returning mechanism for the controlling unit. The stopper is actuated in accordance with the tilting or depression of the side knob. The stopper is surface-mounted on the printed circuit board.

4 Claims, 9 Drawing Sheets

SWITCHING DEVICE INCLUDING STOPPER SURFACE-MOUNTED ON PRINTED CIRCUIT BOARD

This application claims the benefit of Priority to Japanese Patent Application No. 2003-138725, herein incorporated by reference.

BACKGROUND OF THE INVENTION

1. Field of the Invention

The present invention relates to a switching device which can be tilted and is used in a remote controller for menu selection or the like.

2. Description of the Related Art

FIG. 11 schematically illustrates a known switching device. Referring to FIG. 11, a printed circuit board 80 is provided with a seesaw switch 82 in a case 83. The seesaw switch 82 has a tilting knob 81 that is disposed on the surface of the case 83. This seesaw switch 82 further includes a returning mechanism for the tilting knob 81, two switching mechanisms, and a clicking mechanism. The two switching mechanisms are turned on when the tilting knob 81 reaches both ends of the seesaw movement. The clicking mechanism gives a clicking feeling when the seesaw switch 82 is turned on and functions as a stopper, controlling the movement of the tilting knob 81 within a predetermined range. The seesaw switch 82 is attached to the printed circuit board 80 by placing terminals of the seesaw switch 82 in a hole of the printed circuit board 80.

The case 83 of the seesaw switch 82 has an opening so that the tilting knob 81 can tilt therein. Both ends of the opening function as stoppers. A control member (not shown), which is provided on the tilting knob 81, abuts the ends of the opening to thereby prevent the tilting knob 81 from moving. Since the seesaw switch 82 of a known type is constructed as described above, the seesaw switch 82 is required to be small as compared to the size of the tilting knob 81 and thus the ends of the opening are not sturdy enough as stoppers. Furthermore, since the clicking mechanism is small, it cannot provide a precise indication that it has been clicked and provide a sturdy stopping function.

Alternatively, a boss can be provided in the case 83 as a stopper. In this case, however, accumulated errors in fabricating or assembling the device cause larger errors or variations in the positions of the stoppers.

SUMMARY OF THE INVENTION

To solve the aforementioned problems associated with the known switching device, it is an object of the present invention to provide a compact switching device including a sturdy stopper that is precisely positioned at the desired position.

According to the present invention, a switching device comprises printed circuit board, a switch body surface-mounted on a surface of the printed circuit board, the switch body including a controlling unit that is tilted from the perpendicular line to the surface of the printed circuit board, the switch body outputting a predetermined signal in response to tilt of the controlling unit, a tilting knob attached to the controlling unit of the switch body, a returning mechanism for returning the controlling unit to the initial position, and a stopper actuated by operation of the tilting knob, the stopper being surface-mounted on the printed circuit board.

According to the switching device of the present invention, the stopper is separately formed from the switch body so that the switch body provides sturdy stopping function and the switch body and the stopper have small dimensions. Furthermore, since the switch body and the stopper are surface-mounted on the printed circuit board, mounting is facilitated and an additional member for fixing these components is not necessary.

According to the present invention, preferably the stopper has a clicking mechanism in the switching device.

According to the present invention, preferably the stopper has a switching mechanism in the switching device.

According to the present invention, the switching device preferably has a two-level switching mechanism in which the switch body is a first level and the stopper is a second level.

DESCRIPTION OF THE PREFERRED EMBODIMENTS

Figure 1:
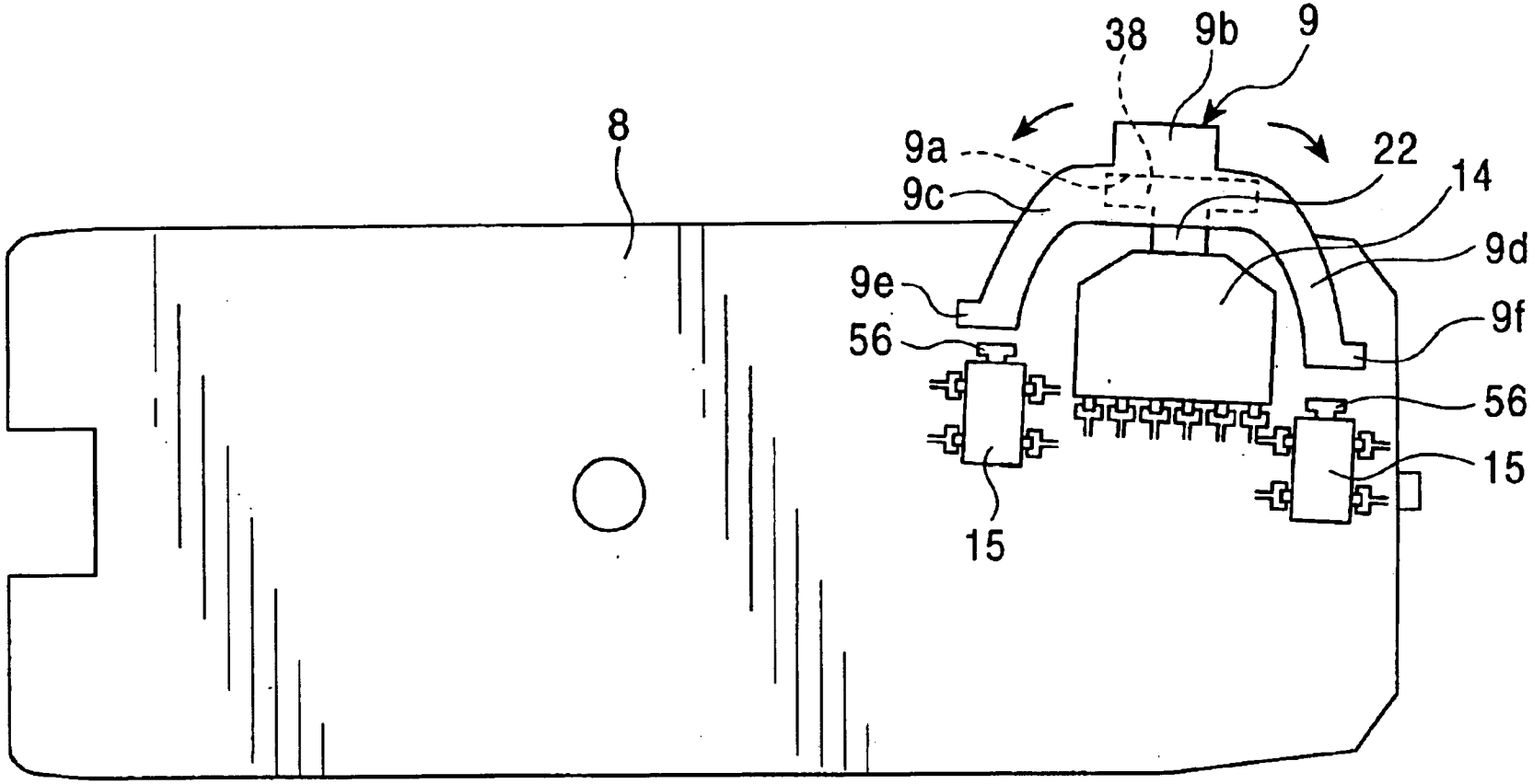
FIG. 1 is a schematic view of a switching device according to an embodiment of the present invention.
Figure 2:
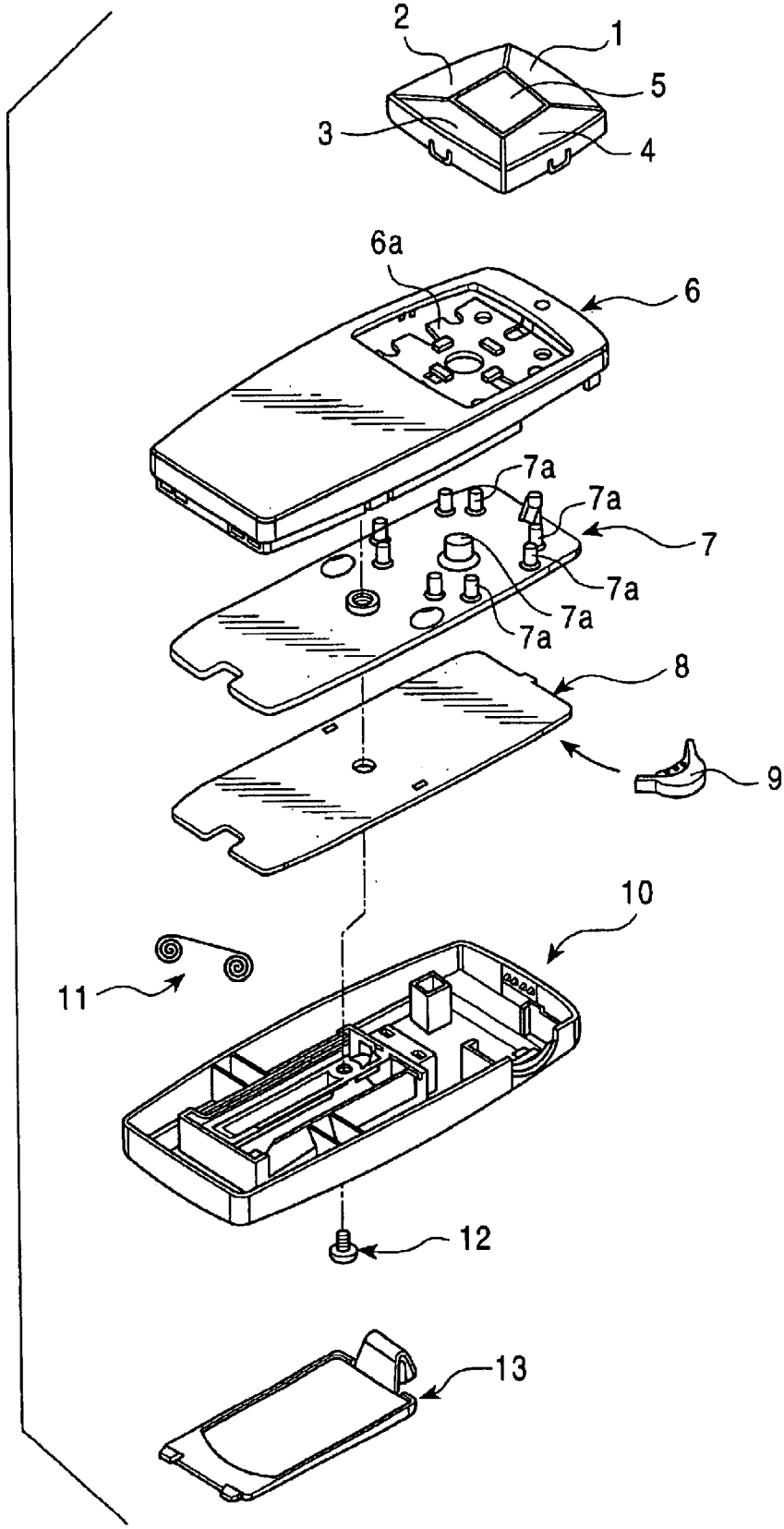
FIG. 2 is an exploded perspective view of the switching device.
Figure 3:
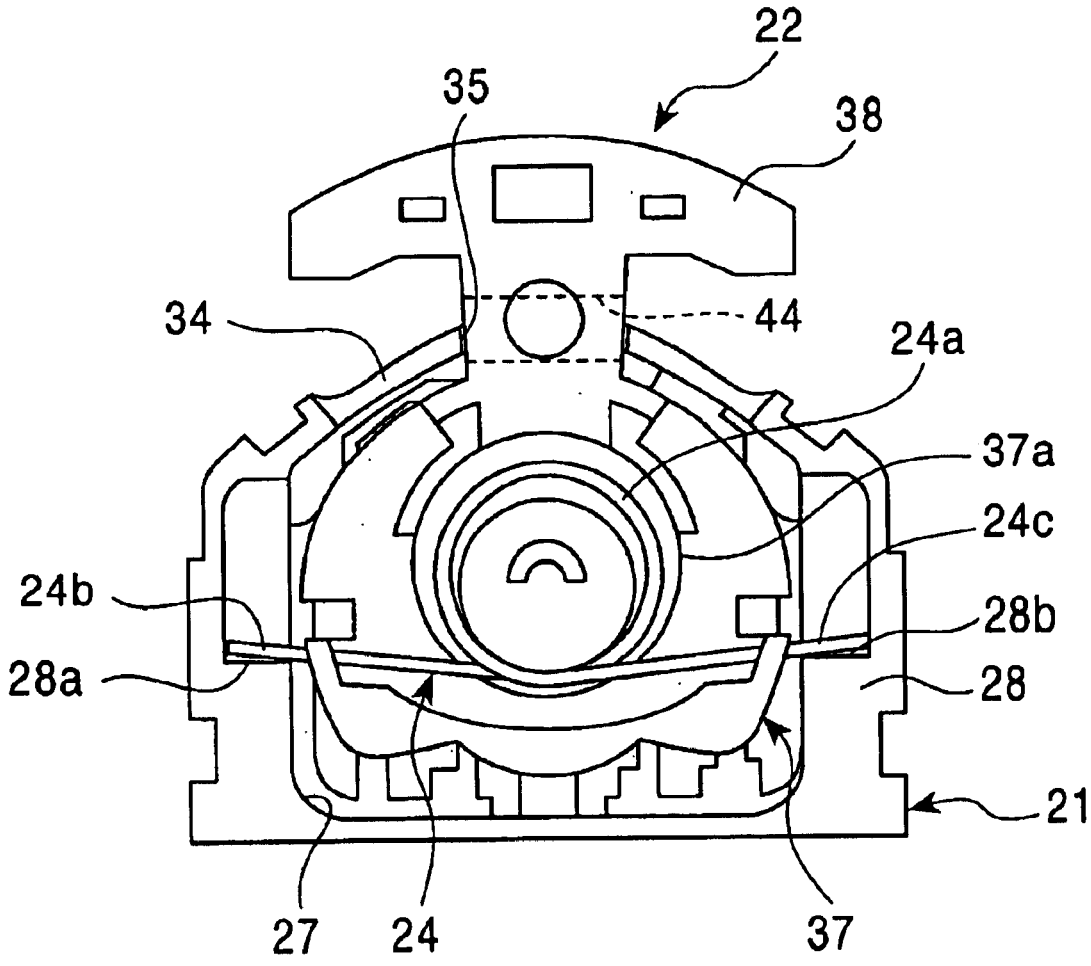
FIG. 3 is a perspective view of a switch body in the switching device.
Figure 4:
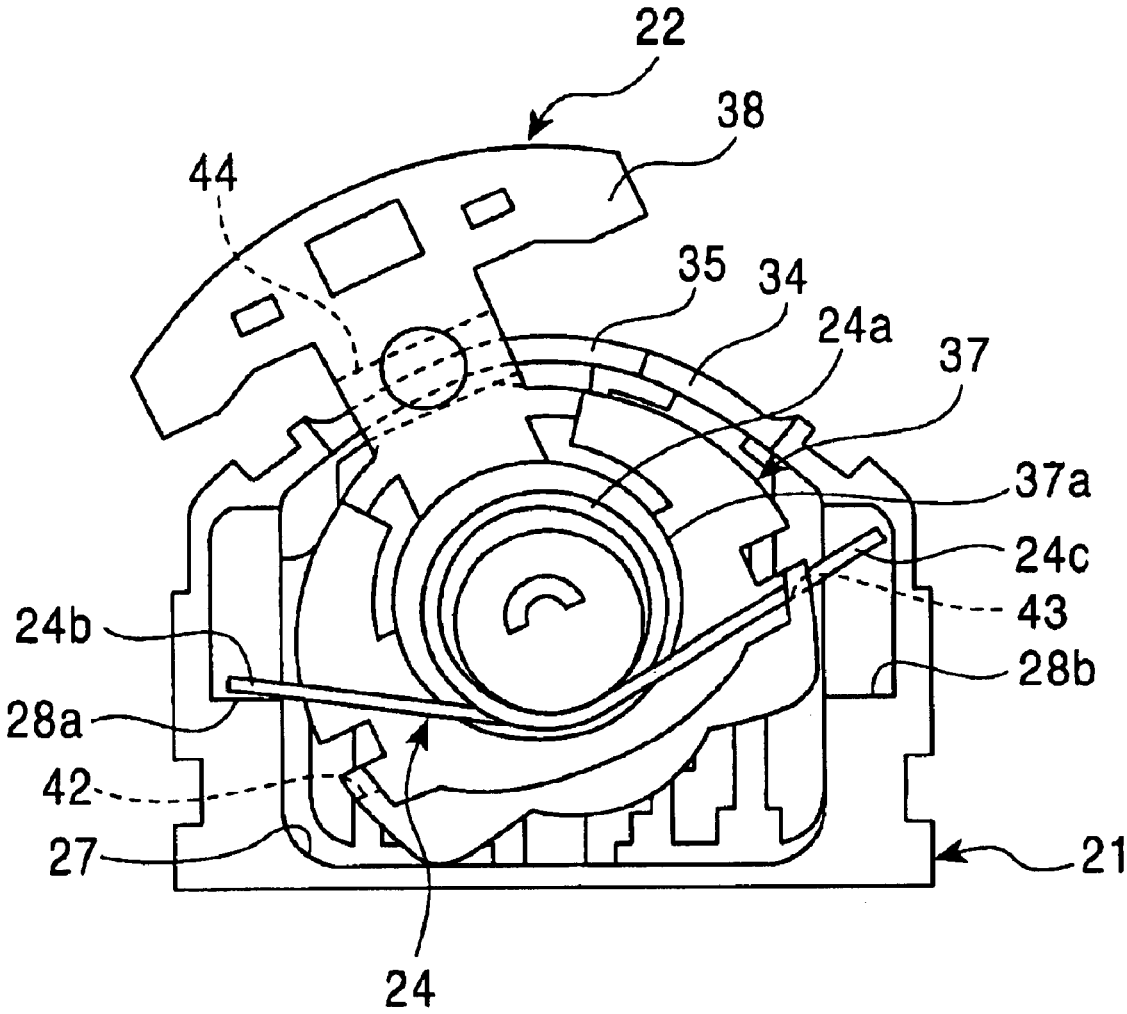
FIG. 4 is a perspective view of the switch body when it is tilted.
Figure 5:
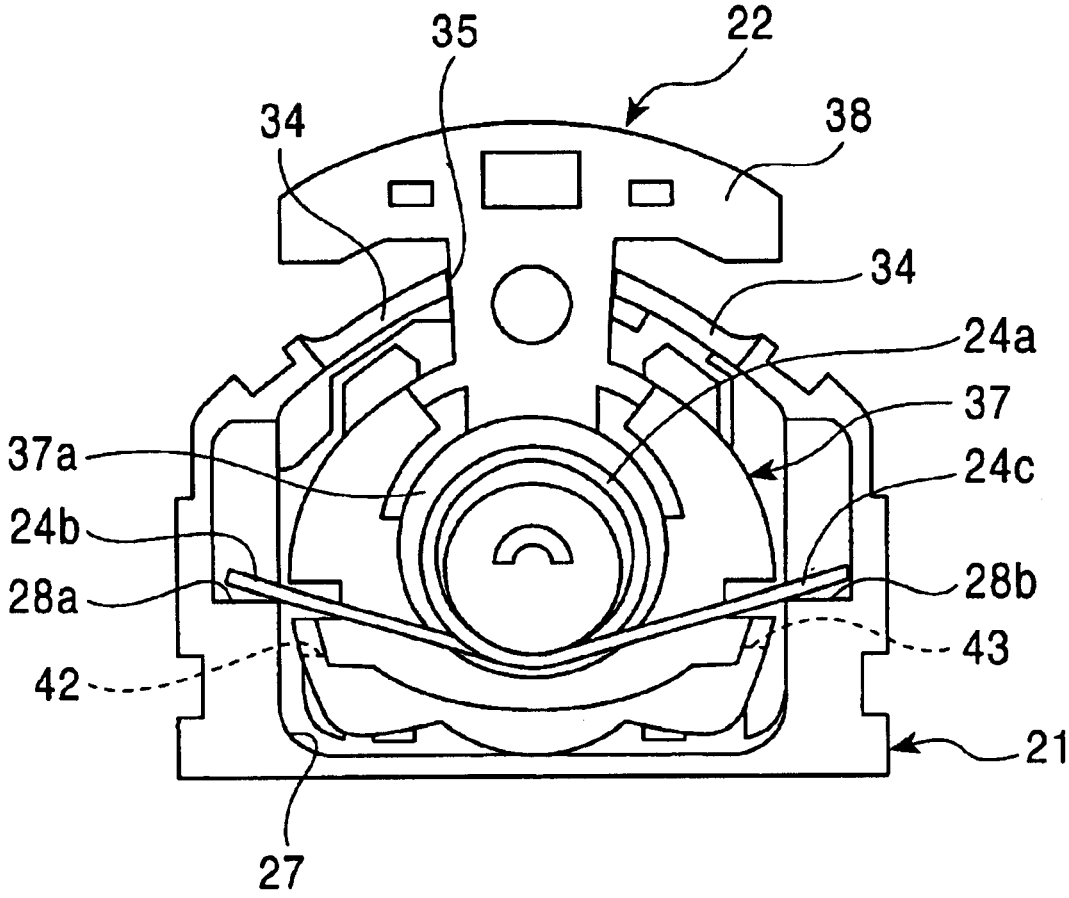
FIG. 5 is a perspective view of the switch body when it is depressed.
Figure 6:
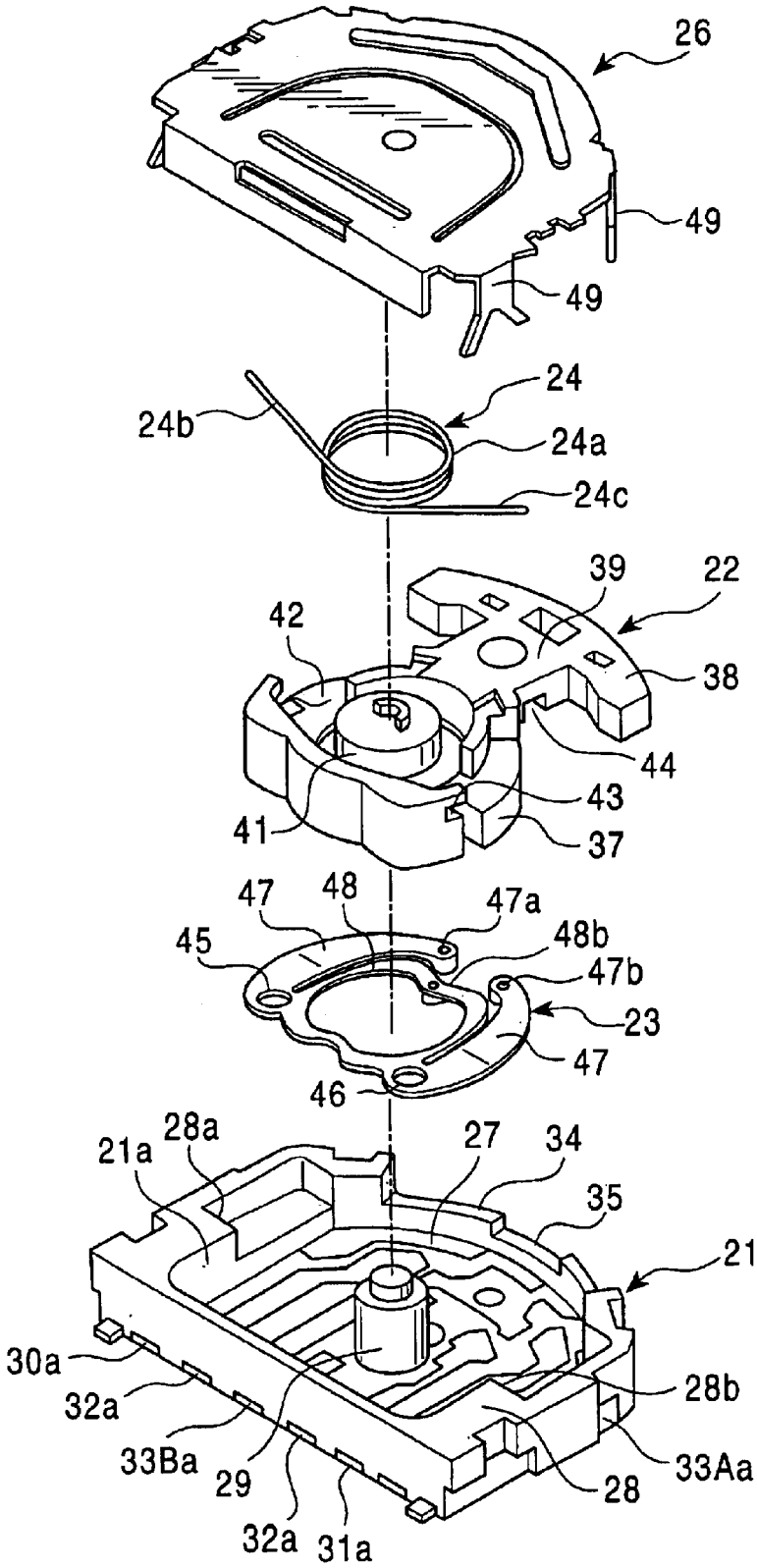
FIG. 6 is an exploded perspective view of the switch body.
Figure 7:
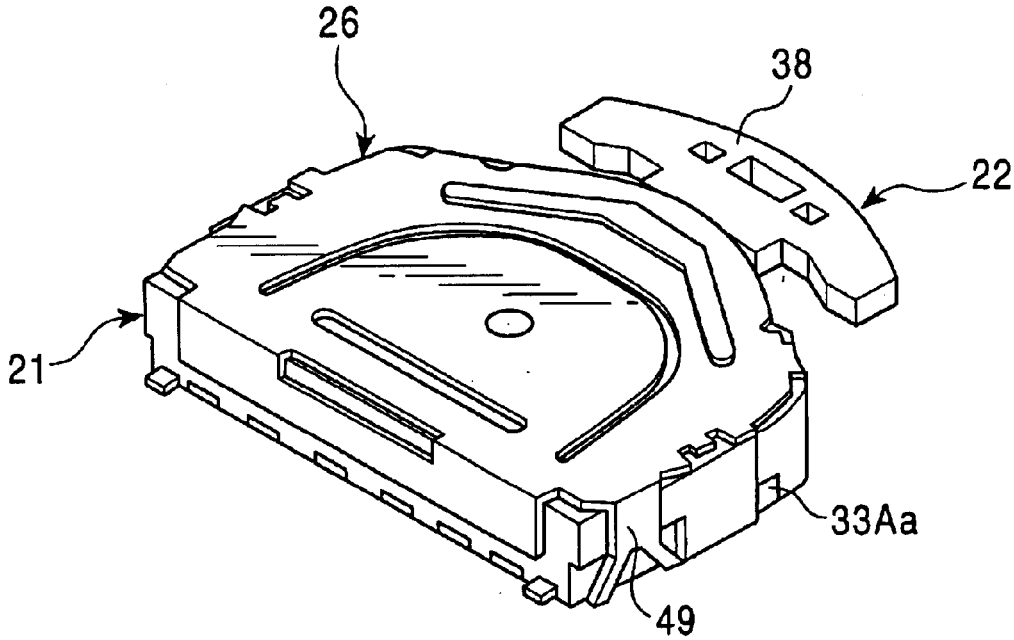
FIG. 7 is a perspective view of the switch body.
Figure 8:
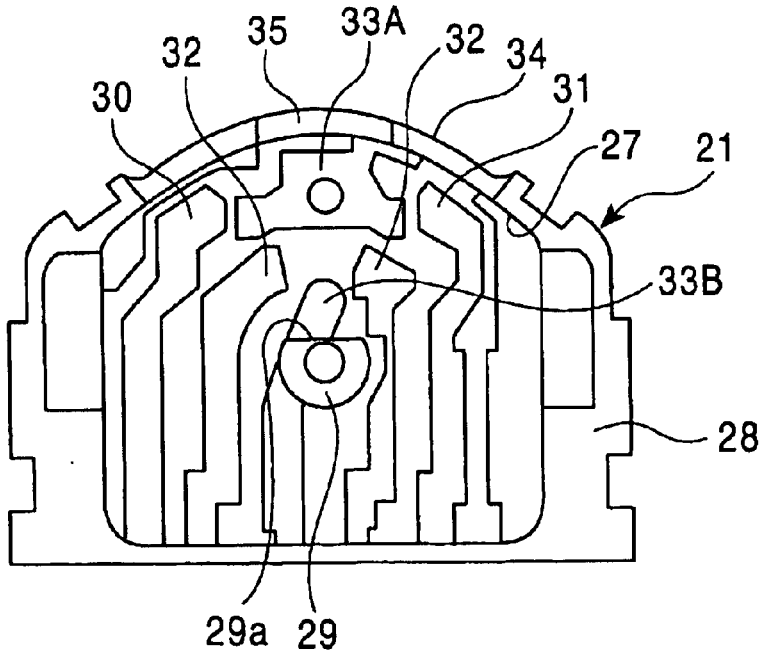
FIG. 8 is a plan view of a wafer in the switch body.
Figure 9:
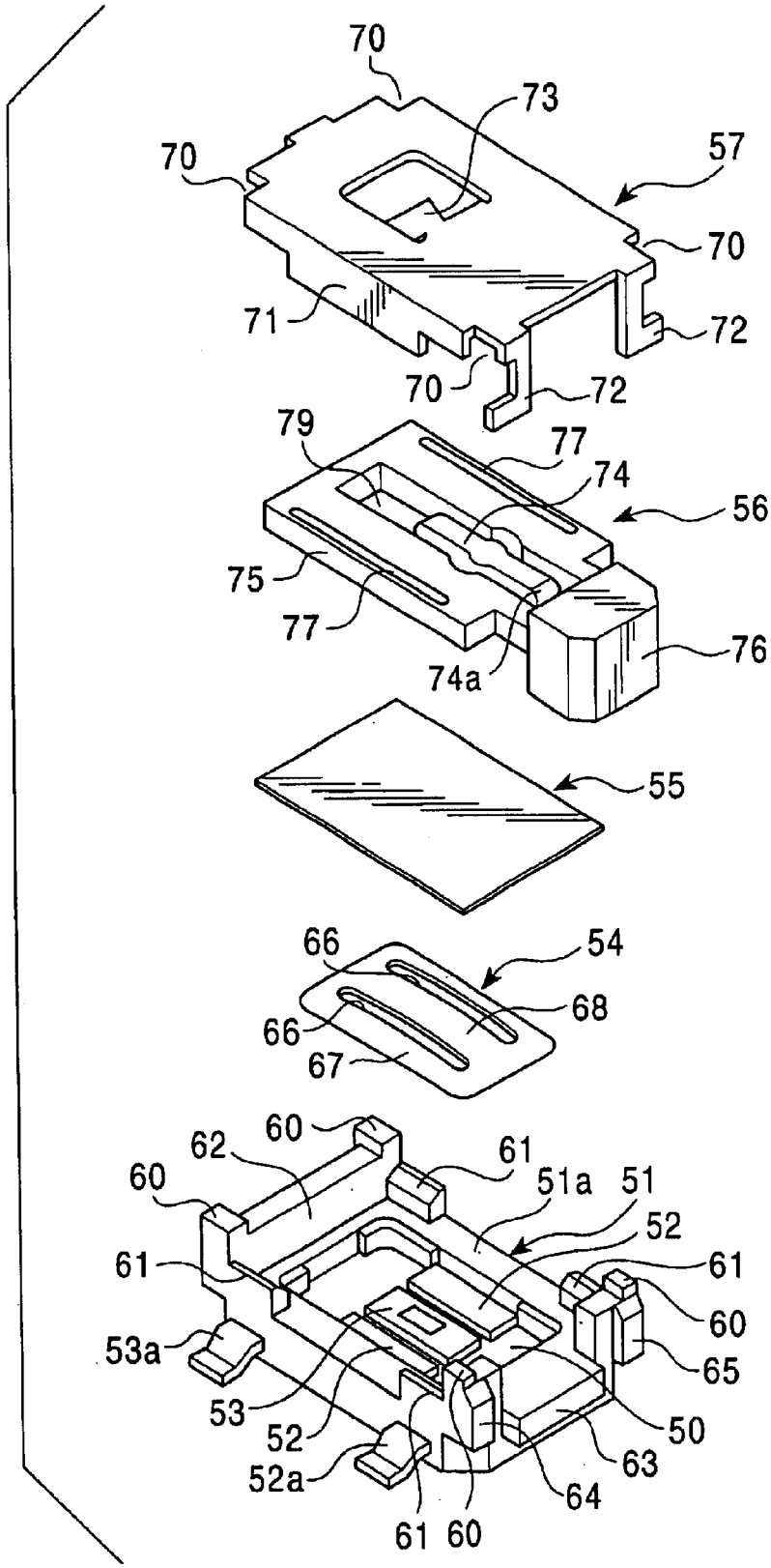
FIG. 9 is an exploded perspective view of a push switch according to an embodiment.
Figure 10:
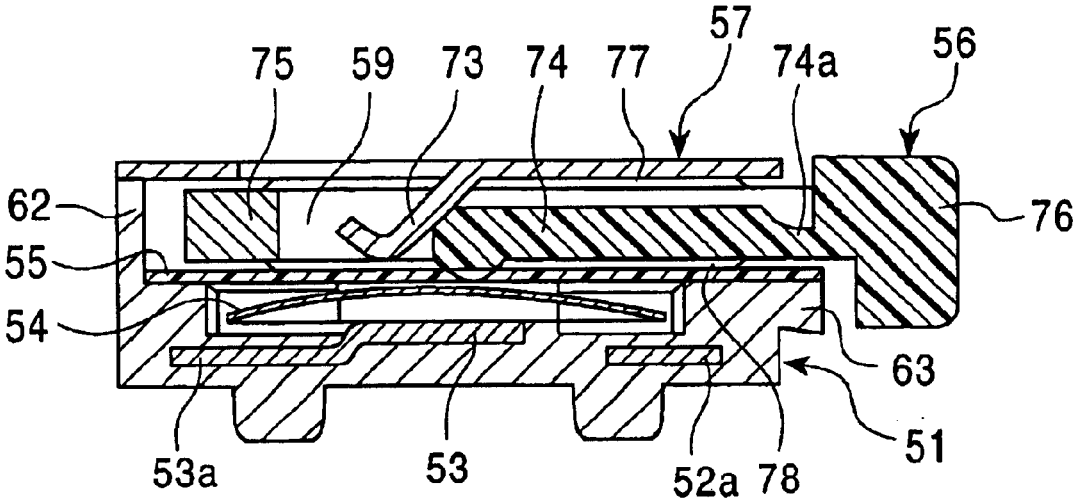
FIG. 10 is a cross-sectional view of a principal portion of the push switch in which the components illustrated in FIG. 9 are assembled.
Figure 11:
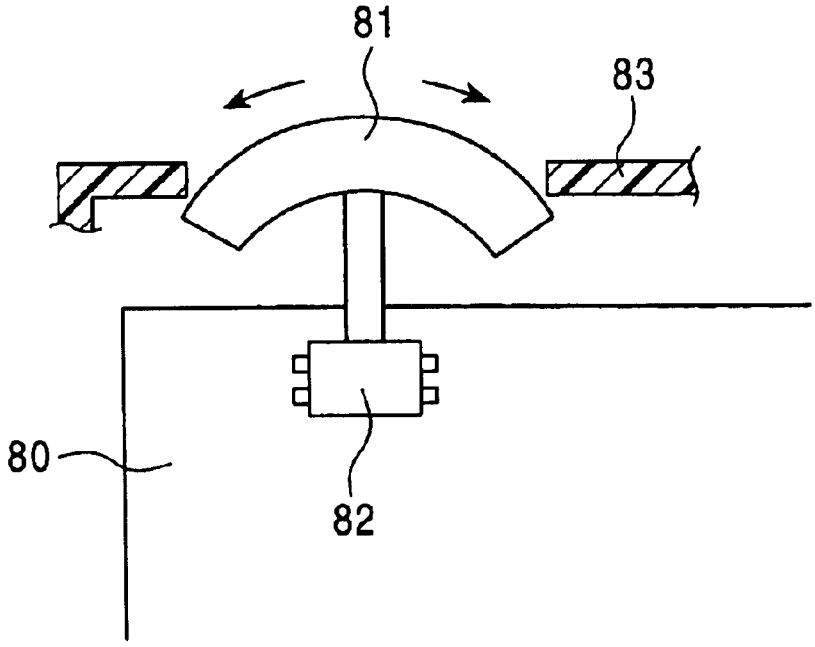
FIG. 11 PRIOR ART
FIG. 11 is a side view of a known switching device.

The embodiments of the present invention will now be described by referring to the accompanying drawings. FIG. 1 is a schematic view of a switching device according to an embodiment of the present invention. FIG. 2 is an exploded perspective view of the switching device. FIG. 3 is a perspective view of a switch body in the switching device. FIG. 4 is a perspective view of the switch body when it is tilted. FIG. 5 is a perspective view of the switch body when it is depressed. FIG. 6 is an exploded perspective view of the switch body. FIG. 7 is a perspective view of the switch body. FIG. 8 is a plan view of a wafer in the switch body. FIG. 9 is an exploded perspective view of a push switch according to an embodiment. FIG. 10 is a cross-sectional view of a principal portion of the push switch in which the components illustrated in FIG. 9 are assembled.

The switching device is included in a menu selection remote controller, as shown in FIG. 2. This remote controller has a top case 6, a rubber plate 7, a printed circuit board 8, a side knob 9, a bottom case 10, a battery terminal 11, a screw 12, and a battery cover 13. The top case 6 has a key accommodating unit 6*a* that accommodates direction keys 1, 2, 3, and 4 and a confirmation key 5. The rubber plate 7 is provided with click rubber contacts 7*a* which are hollow projecting members and correspond to the direction keys 1, 2, 3, and 4 and the confirmation key 5. The rubber plate 7 is placed on the printed circuit board 8. The printed circuit board 8 is provided with fixed contacts (not shown) that correspond to the click rubber contacts 7*a*. The side knob 9 is a component of the switching device, which will be described below, and the side knob 9 is surface-mounted on the back surface of the printed circuit board 8. The rubber plate 7 and the printed circuit board 8 are interposed between the top case 6 and the bottom case 10. A battery terminal 11 is attached to the battery accommodating unit 10*a* of the bottom case 10. The screw 12 holds the bottom case 10, the printed circuit board 8, the rubber plate 7, and the top case 6 together in this order. The battery cover 13 is fitted in a battery accommodating unit 10*a* of the bottom case 10.

The switching device is surface-mounted on the back surface of the printed circuit board 8, as shown in FIG. 1. This switching device has a switch body 14, the side knob 9, a returning mechanism, and stoppers 15. The switch body 14 and the stoppers 15 are surface-mounted on the printed circuit board 8. The returning mechanism is provided in the switch body 14. The side knob 9 is attached to the switch body 14 and is capable of being tilted.

With reference to FIGS. 3 to 8, the switch body 14 will now be described. Referring to FIG. 6, the switch body 14 is mainly composed of a wafer 21, a controlling unit 22, a sliding unit 23, a coil spring 24, and a cover 26. The wafer 21 is composed of synthetic resin and has a top opening 21*a*. The controlling unit 22 is placed on the wafer 21 so as to be tilted and depressed. The sliding unit 23 is a conductive, elastic plate that is fixed to the bottom face of the controlling unit 22. The coil spring 24 has a center coil portion 24*a* and arms 24*b* and 24*c* that protrude from both ends of the coil portion 24*a*. The cover 26 covers the top opening 21*a* of the wafer 21.

Referring to FIG. 8, the wafer 21 includes a base 27 and a wall 28. The wafer 21 has a substantially rectangular shape with one arched side. The wall 28 is provided around the circumference of the base 27 and a pair of holding steps 28*a* and 28*b* is formed on the wall 28. A spindle 29 is provided in the center of the base 27 and supports the controlling unit 22. The spindle 29 has a flat side 29*a* perpendicular to a depressed direction at the upper side in FIG. 8, where the controlling unit 22 is depressed in the depressed direction. Tilting detectable fixed contacts 30 and 31, depression detectable fixed contacts 32, a first common fixed contact 33B for detecting depression, and a second common fixed contact 33A are integrally formed. The tilting detectable fixed contacts 30 and 31 are formed on the base 27 along the direction in which the controlling unit 22 is tilted. The depression detectable fixed contacts 32 and the first common fixed contact 33B are disposed in the area between the tilting detectable fixed contacts 30 and 31. Relative to the tilting detectable fixed contacts 30 and 31, the depression detectable fixed contacts 32 and the first common fixed contact 33B are situated lower in height extending in the direction along which the controlling unit 22 is depressed in FIG. 8. The second common fixed contact 33A is disposed between the tilting detectable fixed contacts 30 and 31 along the direction in which the controlling unit 22 is tilted. The tilting detectable fixed contacts 30 and 31, the depression detectable fixed contacts 32, the second common fixed contact 33A, and the first common fixed contact 333 are exposed at the outer surface of the wall 28 of the wafer 21 as external terminals 30*a*, 31*a*, 32*a*, 33A*a*, and 33B*a*, respectively. A top side of the wall 28 is arched in the depressed direction with the spindle 29 disposed at the center. A step 34 is formed on this arched side of the wall 28 and defines the range within which the controlling unit 22 is tilted. A recess 35 is formed in the center of the step 34.

Referring to FIG. 6, the controlling unit 22 is symmetric and includes a base 37, a controller 38, and a connecting portion 39. The base 37 is disposed in the wafer 21. The controller 38 protrudes from the wafer 21. The connecting portion 39 connects the base 37 to the controller 38 and is fitted in the step 34 of the wafer 21. A cylindrical boss 41 is disposed in the center of the top surface of the base 37. A slit (not shown) is formed on the bottom face of the base 37 extending along the direction in which the controlling unit 22 is depressed. The spindle 29 is fitted in a predetermined position of the slit. A circumferential groove 37*a* is formed around the circumference of the boss 41. A pair of engageable grooves 42 and 43 is formed in a diagonally upward direction from the circumferential groove 37*a*. As shown in FIG. 3, the coil portion 24*a* is wound around the boss 41 in the circumferential groove 37*a*, and the arms 24*b* and 24*c* extend through the engageable grooves 42 and 43 and are held by holding steps 28*a* and 28*b* in the wafer 21. A top side of the slit in the depressed direction is flat, the top side being perpendicular to the longitudinal direction of the slit. This flat top side of the slit is not in contact with the flat side 29*a* of the spindle 29 when the controlling unit 22 is not operated, as shown in FIG. 3, or the controlling unit 22 is tilted, as shown in FIG. 4. The flat side of the slit comes into contact with the flat side 29*a* of the spindle 29, when the controlling unit 22 is depressed, as shown in FIG. 5.

The controller 38 has a semicircular top part. The base 37 is disposed below the center of the semicircular top part of the controller 38 and is attached thereto through the connecting portion 39. A groove 44 is formed on the bottom face of the connecting portion 39 of the controller 38. Referring to FIG. 4, the groove 44 slides over the arched side of the wall 28 with the step 34 when the controlling unit 22 is tilted. Referring to FIG. 5, the groove 44 is moved within the recess 35 of the wafer 21 and housed inside the wall 28 when the controlling unit 22 is depressed in the center position.

The symmetrical sliding unit 23 includes a pair of attachable portions 45 and 46, a pair of sliding members 47, and a ring sliding member 48 which are integrated. The attachable portions 45 and 46 are attached to the bottom surface of the base 37. The sliding members 47 extend from the attachable portions 45 and 46, respectively. The movable contacts 47*a* and 47*b* are provided at the tips of the sliding members 47 and protrude downward. The movable contact 48*b* is formed at the center of the sliding member 48 and protrudes downward. The movable contact 48*b* is in contact with the second common fixed contact 33A when the controlling unit 22 is not operated or when it is tilted.

A plurality of holding members 49 is disposed on the cover 26. These holding members 49 are inserted along the wall 28 of the wafer 21 and the ends of the holding members 49 are bent in two directions, thereby covering the top opening 21*a* of the wafer 21 with the cover 26, as shown in FIG. 7.

When the controlling unit 22 in the switch body 14 is not operated, as shown in FIG. 3, the arms 24*b* and 24*c* of the coil spring 24 are held on the holding steps 28*a* and 28*b* of the wafer 21, respectively. The coil portion 24*a* is wound around the boss 41 of the controlling unit 22 so that the coil spring 24 provides the controlling unit 22 power to return to the center position (returning mechanism). At this time, the groove 44 of the controlling unit 22 faces the recess 35 of the wafer 21 and the flat side of the slit (not shown) of the controlling unit 22 is not in contact with the flat side 29*a* of the spindle 29. The movable contact 48*b* of the sliding unit 23 is in contact with the second common fixed contact 33A, whereas the movable contacts 47*a* and 47*b* are not in contact with the tilting detectable fixed contacts 30 and 31 and the depression detectable fixed contacts 32 so that a tilting switch and a push switch are both off.

In this state, the controller 38 of the controlling unit 22 is tilted counterclockwise, as shown in FIG. 4, the sliding unit 23 rotates about the spindle 29 in association with the movement of the controlling unit 22, and the movable contact 47*a* of the sliding unit 23 comes into contact with the tilting detectable fixed contact 30. Accordingly, the external terminal 30*a* and a common external terminal 33A*a* become electrically connected and thus the tilting switch is turned on to selectively output a first electronic signal. At this time, the arm 24*b* of the coil spring 24 is held on the holding step 28*a* of the wafer 21, while the arm 24*c* is detached from the holding step 28*b* by being depressed in the tilting direction by the end of the engageable groove 43 of the controlling unit 22. Since the arms 24*b* and 24*c* are pressed inward so as to move closer to each other, power to return to the center position is provided to the controlling unit 22. When the controller 38 is released, the controlling unit 22 moves clockwise by the resilience of the coil spring 24 to thereby return by itself to the center position, as shown in FIG. 3, and the movable contact 47*a* is detached from the tilting detectable fixed contact 30, thereby turning off the tilting switch. When the controlling unit 22 is tilted, the groove 44 is disengaged from the recess 35 to slide over the step 34. Therefore, even if the controlling unit 22 is depressed by mistake during tilting of the controlling unit 22, the inner surface of the groove 44 is in contact with the outer surface of the step 34 so that the controlling unit 22 cannot be depressed. Hence, erroneous operation of the controlling unit 22 is avoided.

Similarly, when the controlling unit 22 is tilted clockwise, the movable contact 48*b* of the sliding unit 23 is always in contact with the second common fixed contact 33A and the movable contact 47*b* comes into contact with the tilting detectable fixed contact 31. Therefore, the external terminal 31*a* and the common external terminal 33A*a* become electrically connected and thus the tilting switch is selectively turned on to output a first electronic signal.

When the controlling unit 22, which is not operated, as shown in FIG. 3, is depressed in a direction towards the wafer 21, the controlling unit 22 and the sliding unit 23 are integrally moved downward, as shown in FIG. 5. Accordingly, the movable contacts 47*a* and 47*b* and the movable contact 48*b* at the sliding unit 23 come into contact with the depression detectable fixed contacts 32 and the first common fixed contact 33B and thus the external terminal 32*a* and the common external terminal 33B*a* become electrically connected. Therefore, the push switch is selectively turned on to output a second electronic signal. At this time, while the arms 24*b* and 24*c* of the coil spring 24 are held on the holding steps 28*a* and 28*b* of the wafer 21, the coil portion 24*a* wound on the boss 41 is moved in a direction along which the controlling unit 22 is depressed. Accordingly, the arms 24*b* and 24*c* are pressed inward so as to move closer to each other and thus power to return to the center position is provided to the controlling unit 22. When the controller 38 is released, the controlling unit 22 returns by itself to the center position shown in FIG. 3 by the resilience of the coil spring 24. Therefore, the movable contacts 47*a* and 47*b* and the movable contact 48*b* are detached from the depression detectable fixed contacts 32 and the first common fixed contact 33B and thus the push switch is turned off. When the controlling unit 22 is depressed, the groove 44 is moved towards the spindle 29 from the wall 28 through the recess 35. Thus, even if the controlling unit 22 is tilted by mistake during depression of the controlling unit 22, the connecting portion 39 comes into contact with the side walls which connect the recess 35 with the step 34 and thus the controlling unit 22 cannot be tilted. Hence, erroneous operation of the controlling unit 22 is avoided.

The stopper 15 serving as a push switch will now be described with reference to FIGS. 9 and 10.

Referring to FIG. 9, the push switch according to the present invention has a housing 51, fixed contacts 52 and 53, a movable contact 54, a dust-proof sheet 55, a controlling member 56, and a cover 57. The housing 51 has a space 50. The fixed contacts 52 and 53 are provided on the bottom face of the space 50, and the movable contact 54 is disposed above the fixed contacts 52 and 53. The dust-proof sheet 55 is composed of, for example, polyamide and is placed over the movable contact 54. The controlling member 56 actuates the movable contact 54 with the dust-proof sheet 55 interposed therebetween. The cover 57 is placed on the space 50 to close the opening.

The aforementioned fixed contacts 52 and 53 are integrally formed with the housing 51 by insert molding. External terminals 52*a* and 53*a* protruding from the fixed contacts 52 and 53 are provided on the exterior wall of the housing 51. The housing 51 includes four protrusions 60, guiding members 61, a wall 62, a block member 63, and holding members 64 and 65. The protrusions 60 protrude upward from the four corners of the housing 51. The guiding members 61 are disposed in the vicinity of the protrusions 60 and guide the controlling member 56. The wall 62 protrudes upward from a first side of the housing 51. The block member 63 protrudes outward from a second side of the housing 51 that faces the first side. The holding members 64 and 65 protrude outward from the protrusions 60 provided on the second side and hold the cover 57.

The movable contact 54 is an elastic thin metal plate and is disposed in the space 50 of the housing 51. The movable contact 54 is composed of two trenches 66, a peripheral portion 67, and an arched midsection 68. The trenches 66 are parallel to the direction along which the controlling member 56 moves. The peripheral portion 67 is always in contact with the fixed contact 52. The midsection 68 is arched and disposed above the fixed contact 53. The peripheries of the dust-proof sheet 55 are placed over a top surface 51*a* of the housing 51. The controlling member 56 is mounted on top of the dust-proof sheet 55.

The cover 57 includes recessed portions 70, walls 71, a pair of arms 72, and an inclined portion 73. The recessed portions 70 are provided at the four corners thereof and are engageable with the protrusions 60. The walls 71 protrude downward from two opposing sides of the cover 57 and are in contact with top surfaces 51*a* of the housing 51 and the top surfaces of the guiding members 61. The arms 72 protrude downward from another side orthogonal to the opposing sides and are engageable with the holding members 64 and 65. The inclined portion 73 is cut out in the center of the cover 57. The inclined portion 73 faces the midsection 68 of the movable contact 54 and inclines towards the housing 51. Though not illustrated, the inclined portion 73 is formed in the following manner. Two slits parallel to the direction along which the controlling member 56 is tilted are formed and the side of the rectangular area between the slits close to the wall 62 is cut out such that the inclined portion 73 is bent downward.

The controlling member 56 is integrally formed of, for example, a synthetic resin including carbon fiber. The controlling member 56 includes an actuator 74, a guiding member 75, and a pressing member 76. The actuator 74 is interposed between the inclined portion 73 and the midsection 68 of the movable contact 54. The guiding member 75 with a rectangular U-shape is provided so as to enclose the actuator 74 and slides over the guiding members 61. The pressing member 76 protrudes outward from one side of the housing 51. A thin portion 74*a* connects the elastic actuator 74 to the pressing member 76. A pair of guiding protrusions 77 is provided on the top surface of the guiding member 75 such that they extend parallel to the direction along which the controlling member 56 moves. The guiding protrusions 77 slide along the inner surface of the cover 57. A pair of guiding protrusions 78 is provided on the bottom face of the guiding member 75 such that they extend parallel to the direction along which the controlling member 56 moves, as shown in FIG. 10. The inclined portion 73 is engageable with an opening 79 enclosed by the actuator 74 and the guiding member 75.

With the push switch of the present invention, when the pressing member 76 of the controlling member 56 is pressed leftward in FIG. 10 until it abuts the block member 63, the actuator 74 moves counterclockwise in FIG. 10 along the inclined portion 73 as the thin portion 74*a* changes its shape due to its elasticity. Accordingly, the tip of the actuator 74 depresses the midsection 68 of the movable contact 54 through the dust-proof sheet 55. Thus, the midsection 68 is inverted downward to come into contact with the fixed contact 53 and thus the push switch is turned on. The inversion of the midsection 68 gives an indication that the switch has been clicked. When the pressing member 76 is released, the actuator 74 returns to the initial position by moving clockwise in FIG. 10 along the inclined portion 73 due to the resilience of the thin portion 74*a*. As the actuator 74 returns, the midsection 68 of the movable contact 54 is inverted upward due to its resilience and thus is detached from the fixed contact 53, thereby turning off the push switch.

The structure of the switching device according to the present invention will now be described by referring to FIG. 1. As shown in FIG. 1, the switch body 14 is surface-mounted on the back surface of the printed circuit board 8. The external terminals 30*a*, 31*a*, 32*a*. 33A*a*, and 33B*a* in the switch body 14 are soldered to the circuit pattern of the printed circuit board 8. The side knob 9 is attached to the controller 38 of the controlling unit 22 with, for example, a snap or a screw. The side knob 9 includes a recessed portion 9*a*, a projecting portion 9*b*, arms 9*c* and 9*d*, and press portions 9*e* and 9*f*. The recessed portion 9*a* receives and fixes the controller 38 therein. The projecting portion 9*b* is used for operating the controlling unit 22. The arms 9*c* and 9*d* extend from both sides of the projecting portion 9*b* and curve along the tilting direction of the controlling unit 22. The press portions 9*e* and 9*f* are provided at the tips of the arms 9*c* and 9*d*, respectively. The stoppers 15 are provided below the press portions 9*e* and 9*f* and are surface-mounted on the printed circuit board 8. When the side knob 9, namely, the controlling unit 22 of the switch body 14 is tilted rightward, the press portion 9*f* of the arm 9*d* depresses the controlling member 56 of the right stopper 15. When the side knob 9 is tilted leftward, the press portion 9*e* of the arm 9*c* depresses the controlling member 56 of the left stopper 15. When the side knob 9, namely, the controlling unit 22 of the switch body 14 is pressed down in its neutral position, the arms 9*c* and 9*d* are depressed and thus the press portions 9*e* and 9*f*, in turn, depress the controlling members 56 of the stoppers 15. Since the controlling members 56 define the range within which the controlling unit 22 of the switch body 14 is tilted, the stoppers 15 provide sufficient strength. In addition, the switch body 14 and the stoppers 15 have small dimensions. The switch body 14 and the stoppers 15 are surface-mounted on the printed circuit board 8, whereby mounting is simplified and an additional member such as a case for fixing them on the printed circuit board 8 is not necessary.

Operation of a switching device which provides indications that the switch has been clicked twice by means of two switches will be described as an example of the switching device of the present invention below.

FIG. 1 shows the switching device of the present invention in a non-operational state. FIG. 3 illustrates the switch body 14 incorporated in the switching device shown in FIG. 1. As the side knob 9, that is, the controlling unit 22 of the switch body 14 in the non-operational state shown in FIGS. 1 and 3 is tilted counterclockwise, the sliding unit 23 rotates about the spindle 29 in association with the movement of the controlling unit 22. Therefore, the movable contact 47*a* of the sliding unit 23 comes into contact with the tilting detectable fixed contact 30. As a result, the external terminal 30*a* and the common external terminal 33A*a* become electrically connected and thus the tilting switch, i.e., a first level switch, is selectively turned on, thereby outputting a first electronic signal. By the counterclockwise tilting of the side knob 9, the press portion 9*e* of the arm 9*c* presses down the controlling member 56 of the left stopper 15. When the side knob 9 is tilted exceeding a certain angle, the first electronic signal is canceled. After that, the side knob 9 is further tilted counterclockwise so that the pressing member 76 of the controlling member 56 is pressed leftward in FIG. 10 until it abuts the block member 63. As the thin portion 74*a* of the actuator 74 changes its shape, the actuator 74 of the controlling member 56 moves along the inclined portion 73 counterclockwise in FIG. 10. The tip of the actuator 74 depresses the midsection 68 of the movable contact 54 through the dust-proof sheet 55. Accordingly, the midsection 68 is inverted downward to come into contact with the fixed contact 53, thereby turning on a second level switch. This inversion of the midsection 68 gives an indication that the switch has been clicked. The pressing member 76 abuts the block member 63 so that further tilting of the side knob 9 is restricted.

When the side knob 9 stops moving, the actuator 74 moves clockwise in FIG. 10 along the inclined portion 73 due to the resilience of the thin portion 74*a*. Accordingly, the controlling member 56 slides rightward in FIG. 10 to return to the initial position, thereby turning off the second level switch. Concurrently, the controlling unit 22 moves clockwise due to the resilience of the coil spring 24 to thereby return to the center position shown in FIG. 3 and thus the movable contact 47*a* is detached from the tilting detectable fixed contact 30, thereby turning off the tilting switch.

Similarly, when the side knob 9 is tilted clockwise, the movable contact 48*b* of the sliding unit 23 is always in contact with the second common fixed contact 33A and the movable contact 47*b* comes into contact with the tilting detectable fixed contact 31 so that the external contact 31*a* and the common external terminal 33A*a* become electrically connected. Accordingly, the tilting switch, that is a first level switch, is selectively turned on and thus a first electronic signal is output. By the clockwise movement of the side knob 9, the press portion 9*f* of the arm 9*d* presses down the controlling member 56 of the right stopper 15. When the side knob 9 is tilted exceeding a certain angle, the first electronic signal is canceled. After that, the side knob 9 is further tilted clockwise, whereby the pressing member 76 of the controlling member 56 is pressed leftward in FIG. 10 until it abuts the block member 63. The actuator 74 of the controlling member 56 moves along the inclined portion 73 counterclockwise in FIG. 10, as the thin portion 74*a* of the actuator 74 changes its shape. Accordingly, the tip of the actuator 74 depresses the midsection 68 of the movable contact 54 through the dust-proof sheet 55. The midsection 68 is inverted downward to come into contact with the fixed contact 53, thereby turning on the second level switch. This inversion of the midsection 68 gives an indication that the switch has been clicked. The pressing member 76 abuts the block member 63 so that further tilting of the side knob 9 is restricted.

When the controller 38 in the side knob 9 (the controlling unit 22) shown in FIG. 1 in a non-operational state is depressed, the controlling unit 22 and the sliding unit 23 are integrally moved downward, as shown in FIG. 5.

By this downward movement of the controlling unit 22 and the sliding unit 23, the movable contacts 47*a* and 47*b* and the movable contact 48*b* in the sliding unit 23 come into contact with the depression detectable fixed contacts 32 and the first common fixed contact 33B, respectively and thus the external terminal 32*a* and the common external terminals 33B*a* become electrically connected. Accordingly, the push switch is selectively turned on and thus a second electronic signal is output. At this time, while the arms 24*b* and 24*c* of the coil spring 24 are held on the holding steps 28*a* and 28*b* of the wafer 21, the coil portion 24*a* wound about the boss 41 is moved in the direction along which the controlling unit 22 is depressed. Since the arms 24*b* and 24*c* are pressed inward so as to move closer to each other, the controlling unit 22 is provided power to return to the center position. Additionally, the side knob 9 (the controlling unit 22) in a non-operational state is pressed down so that the arms 9*c* and 9*d* are moved downward to depress the controlling members 56 of the stoppers 15 by the press portions 9*e* and 9*f*. When each of the pressing members 76 of the controlling members 56 is pressed leftward in FIG. 10 until it abuts the block member 63, the actuator 74 of the controlling member 56 moves counterclockwise in FIG. 10 along the inclined portion 73 as the thin portion 74*a* of the actuator 74 changes its shape. Accordingly, the tip of the actuator 74 depresses the midsection 68 of the movable contact 54 through the dust-proof sheet 55 so that the midsection 68 is inverted downward which gives an indication that the switch has been clicked. When the controlling unit 22 is depressed, only the push switch in the switch 14 is activated and therefore the stoppers 15 do not function as push switches. Turning on the push switch in the switch body 14 gives an indication that the switch has been clicked.

When the side knob 9 is released, the stoppers 15 of the controlling members 56 return to the non-operational state as described above. By the resilience of the coil spring 24, the controlling unit 22 of the switch body 14 moves upward and returns to the center position shown in FIG. 3. Thus, the movable contacts 47*a* and 47*b* and the movable contact 48*b* are detached from the depression detectable fixed contacts 32 and the first common fixed contact 33B, thereby turning off the push switch.

In the above description, the side knob 9 has a one-level push switch, but it may have a two-level switch as in the tilting switch described above. Alternatively, the switch body 14 may consist of only a push switch and the tilting switch may consist of only the stopper 15.

As described above, the stopper 15 is separated from the switch body 14 so that the switching device of the present invention provides a sturdy stopper. Furthermore, even though the side knob 9 is large compared to the size of the switch body 14, the switch body 14 hardly ever breaks. Moreover, the switch body 14 and the stopper 15 in the switching device have small dimensions. The switch body 14 and the stoppers 15 are surface-mounted on the printed circuit board 8, whereby the mounting of these components is facilitated and thus an additional member such as a case for fixing the switch body 14 and the stopper 15 thereon is not necessary. The mounting position of the stopper 15 relative to the switch body 14 is easily altered within the printed circuit board 8. Thus, the timing of when the stopper 15 turns on during the tilting of the side knob 9 (the controlling unit 22 of the switch body 14) can be modified as necessary.

Since the stoppers 15 including a clicking mechanism are separately formed from the switch body 14, it provides a precise indication that the switch has been clicked. The clicking feeling is provided when the switch is turned on so that clicking gives an indication that the switch is turned on, thereby improving operation.

What is claimed is:

1. A switching device comprising:

a printed circuit board;

a switch body surface-mounted on a surface of the printed circuit board, the switch body including a controlling unit capable of being tilted from a perpendicular line to the surface of the printed circuit board, the switch body outputting a predetermined signal in response to tilt of the controlling unit; a tilting knob attached to the controlling unit of the switch body;

a returning mechanism for returning the controlling unit to an initial position, the returning mechanism being provided in the switch body; and a stopper actuated by operation of the tilting knob, the stopper being surface-mounted on the printed circuit board.

2. A switching device according to claim 1, wherein the stopper has a clicking mechanism.

3. A switching device according to claim 2, wherein the stopper has a switching mechanism.

4. A switching device according to claim 3, wherein the switching device has a two-level switching mechanism wherein the switch body is a first level and the stopper is a second level.

* * * * *